US008777061B1

(12) United States Patent
Meshberg

(10) Patent No.: US 8,777,061 B1
(45) Date of Patent: Jul. 15, 2014

(54) SAFETY CLOSURE FOR CONTAINER

(76) Inventor: Emil Meshberg, Fairfield, CT (US)

( * ) Notice: Subject to any disclaimer, the term of this patent is extended or adjusted under 35 U.S.C. 154(b) by 0 days.

(21) Appl. No.: 13/411,521

(22) Filed: Mar. 3, 2012

(51) Int. Cl.
*B67B 1/00* (2006.01)
*B65D 83/00* (2006.01)

(52) U.S. Cl.
USPC ..... 222/153.13; 222/153.11; 222/402.11

(58) Field of Classification Search
USPC ..... 222/153.11, 153.14, 153.13, 384, 222/402.11; 215/216–219, 214
See application file for complete search history.

(56) References Cited

U.S. PATENT DOCUMENTS

| | | | | |
|---|---|---|---|---|
| 3,429,483 | A * | 2/1969 | Micallef | 222/153.11 |
| 3,828,982 | A * | 8/1974 | Steigerwald | 222/153.11 |
| 4,024,988 | A * | 5/1977 | Starrett | 222/153.11 |
| 4,773,567 | A * | 9/1988 | Stoody | 222/153.11 |
| 5,224,615 | A | 7/1993 | Hickerson | |
| 5,282,551 | A * | 2/1994 | Pierson | 222/153.11 |
| 5,379,924 | A * | 1/1995 | Taylor | 222/402.11 |
| 5,458,263 | A * | 10/1995 | Ciammitti et al. | 222/153.1 |
| 5,628,627 | A | 5/1997 | Fairbanks et al. | |
| 5,706,962 | A | 1/1998 | Tauber | |
| 5,772,080 | A * | 6/1998 | de Pous et al. | 222/321.7 |
| 5,979,681 | A * | 11/1999 | PatrickJean-Luc Andre et al. | 215/216 |
| 6,168,035 | B1 | 1/2001 | Mclelland | |
| 6,691,896 | B2 * | 2/2004 | Meshberg | 222/153.13 |
| 6,932,244 | B2 * | 8/2005 | Meshberg | 222/153.13 |
| 7,168,594 | B2 | 1/2007 | Law et al. | |
| 7,434,707 | B2 * | 10/2008 | Meshberg | 222/153.14 |
| 2003/0038146 | A1 * | 2/2003 | Meshberg | 222/153.13 |
| 2004/0026454 | A1 * | 2/2004 | Meshberg | 222/153.14 |
| 2007/0119870 | A1 * | 5/2007 | Lasserre et al. | 222/321.8 |

* cited by examiner

*Primary Examiner* — Paul R Durand
*Assistant Examiner* — Benjamin R Shaw
(74) *Attorney, Agent, or Firm* — Gold & Rizvi, P.A.; Glenn E. Gold

(57) ABSTRACT

A security cap includes a cap body having a base portion and an upstanding wall extending longitudinally upward from a top edge thereof. An actuator is assembled within an interior of the upstanding wall, the actuator being longitudinally movably and axially rotatable enabling cycling between a locked state and an unlocked state. The actuator is rotationally governed by a rotation locking member comprising a push button and an arched biasing member. The push button extends through an aperture provided in the actuator and engages with a vertical edge integrated along a recess formed within the upstanding wall. Vertical motion is governed by a projecting locking feature extending from the actuator. The locking feature engages with a actuation governing edge in a locked state and rotates free of the governing edge into an unlocked, dispensing state, enabling vertical motion of the actuator for dispensing contents from with the container.

24 Claims, 10 Drawing Sheets

SAFETY CLOSURE FOR CONTAINER

FIELD OF THE INVENTION

The present disclosure generally relates to the field of product dispensing pumps, and more particularly to a safety closure comprising a multi-element security cap which requires two independent motions to place the dispensing pump in a condition that enables dispensing of the product from within a container.

BACKGROUND OF THE INVENTION

Over the years many types of dispensing containers have been developed that provide a security feature to prevent undesired and unsafe dispensing of a product contained therein. These containers may store products such as cleaners, lotions, insect repellant, medications, sanitizers and the like, which may be dispensed as desired for use. However, there are many instances where dispensing of the product may be toxic or harmful to a person. A primary example would be when a small child inadvertently gains access to a dispensing container storing a toxic substance. In this situation it is advantageous to have a closure such as cap or lid on the dispensing container that prevents the child from obtaining the toxic substance from within the container. By doing so, this prevents unwanted ingestion of the product by the child and/or undesired application/spillage of the product.

A variety of child-resistant closures are known to exist. Generally these include various threaded caps that cooperate with a corresponding container to prevent removal of the cap without first performing a secondary task that disengages a portion of the cap from a portion of the container. While this known solution is somewhat useful, it presents drawbacks. The safety function of this known solution may be overcome by simply forcing the cap to turn with respect to the container. The threaded solutions are not easily adaptable to pump and/or aerosol dispensers.

Another known solution provides a one-time locking apparatus that also provides a user with evidence of tampering. The locking/child-resistance feature is generally only applicable for the initial use, wherein any subsequent access to the product is without hindrance. While this solution is somewhat useful, it presents a significant drawback of only providing protection from access to undesired/unsafe products for the first use only. In the situation where the product is a single-dose this may be beneficial. Conversely, once the one-time locking feature is removed from a container storing a quantity of product for multiple doses, the housed product may be undesirably accessed by an unintended person such as a child.

In a further known solution, a pump assembly attached or integrated into a bottle. A pump actuator is provided to operate the pump for dispensing of a product housed within the bottle. The pump actuator assembly includes a dispensing actuator locking interface which governs vertical motion of the pump actuator. The dispensing actuator locking interface includes a projecting locking feature extending outward from an upper portion of the pump actuator. The projecting locking feature is retained in a locked configuration by an engagement edge of an actuator control feature. The projecting locking feature disengages from the actuator control feature by rotating the pump actuator. Rotation of the pump actuator is restricted by a rotation locking member extending hingeably outward from the pump actuator. The rotation locking member engages with a locking wall, wherein the locking wall is a vertical edge provided in an upstanding wall circumscribing the pump actuator. The rotation locking member configuration presents several limitations. The rotation locking member is an integral feature of the pump actuator, wherein combined into a uniform construction, being formed during the same molding process. The rotation locking member is hingeably attached to the pump actuator using living hinge technology integrated into the molding process and material selection. This configuration risks damage to the hinge, where the rotation locking member can become detached from the pump actuator. Once the rotation locking member is detached, the rotation locking member no longer provides the intended locking function. Since the pump actuator and rotation locking member are fabricated having a uniform construction, the material selection for each feature is not optimized. The hinge portion requires a high spring constant and reduced brittle nature, whereas the pump actuator portion requires a more rigid material. The design of the rotation locking member, including geometry, size, and location, is limited by the inclusion of the hinge. The design limitations restrict the effectiveness of the rotation locking member. This also contributes to the forces required to adequately depress the locking member. A person with limited strength or mobility may find it difficult to apply the force required to depress the locking member. Since the pump actuator and rotation locking member are fabricated having a uniform construction, they are manufactured of the same colored material. This conceals the rotation locking member from the user. This is particularly important for sight impaired individuals, such as the elderly.

Efforts to provide an improved child-resistant closure that overcomes the drawbacks in the prior art have not met with significant success to date. As a result, there is a need in the art for an improved child-resistant closure that provides reliable locking of the closure to prevent undesired dispensing, that enables the use of different materials between the locking feature and the primary components of the closure and that provides a convenient cost effect way to color code various elements of the child-resistant closure.

SUMMARY OF THE INVENTION

The basic inventive concept provides a child-resistant locking interface that restricts operation of a dispensing element of a container. The locking interface is designed to prevent undesired dispensing while enabling a design having optimized geometries and fabrication of differing materials for the various components.

A first aspect of the present invention provides a safety closure system comprising:

a body cap which is one of configured to couple with the dispensing container and integrated into the dispensing container, the body cap comprising an upstanding wall having at least one recess partially bound by a vertical edge, wherein the vertical edge defines a pushbutton locking edge;

a rotating actuator comprising an internal cavity, the rotating actuator rotatably assembled within the body cap to rotatably cycle the rotating actuator between a locked position to avoid dispensing of material from within the container and an unlocked, dispensing position enabling dispensing of material from within the container; and a rotation locking member comprising an arched segment and a push button extending outward from a convex surface of the arched segment, wherein the rotation locking member is operationally assembled within the actuator internal cavity and the push button engages with the vertical edge to restrict a rotational motion of the rotating actuator until the push button is subjected to a compression force which positions the push button inward, clearing the vertical edge, thus enabling rotation of the rotating actuator.

A second aspect of the present invention incorporates a projecting locking feature extending radially outward therefrom;

the body cap further comprising an actuator limit stop, wherein the projecting locking feature engages with the actuator limit stop restricting a longitudinal motion of the rotating dispensing actuator until the rotating dispensing actuator is rotated into the unlocked, dispensing position where the projecting locking feature to a position disengaging from the actuator limit stop, thus enabling the longitudinal motion of the rotating dispensing actuator.

In yet another aspect, the safety closure is coupled to a dispensing container, the dispensing container comprising a container body defining an interior volume having a dispensing orifice.

In yet another aspect, the safety closure is located in dispensing communication with a dispensing orifice of a dispensing container.

In yet another aspect, the push button engages with a push-button locking edge to retain the rotating dispensing actuator in a locked position.

In yet another aspect, the rotating dispensing actuator further comprises a fixed feature formed within the internal cavity, wherein the fixed feature operatively engages with a biasing end of the rotation locking member when the push button is depressed placing the rotation locking member into the unlocked, dispensing position.

In yet another aspect, the safety closure further comprises a dispensing mechanism coupled to the cap body, wherein the dispensing mechanism is actuated by a longitudinal motion of the rotating dispensing actuator, and the dispensing mechanism dispenses contents stored within the container through a discharge port formed within the rotating dispensing actuator.

In yet another aspect, the rotating dispensing actuator is fabricated of a material having a first color and the rotation locking member is fabricated of a material having a second color, wherein the first color and the second color are different.

These and other advantages of the invention will be further understood and appreciated by those skilled in the art by reference to the following written specification, claims and appended drawings.

BRIEF DESCRIPTION OF THE DRAWINGS

The components in the figures are not necessarily to scale, emphasis instead being placed upon illustrating the principles of the invention. The invention will now be described, by way of example, with reference to the accompanying drawings, in which.

In the figures, like reference numerals designate corresponding elements throughout the different views of the drawings.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

Figure 1:
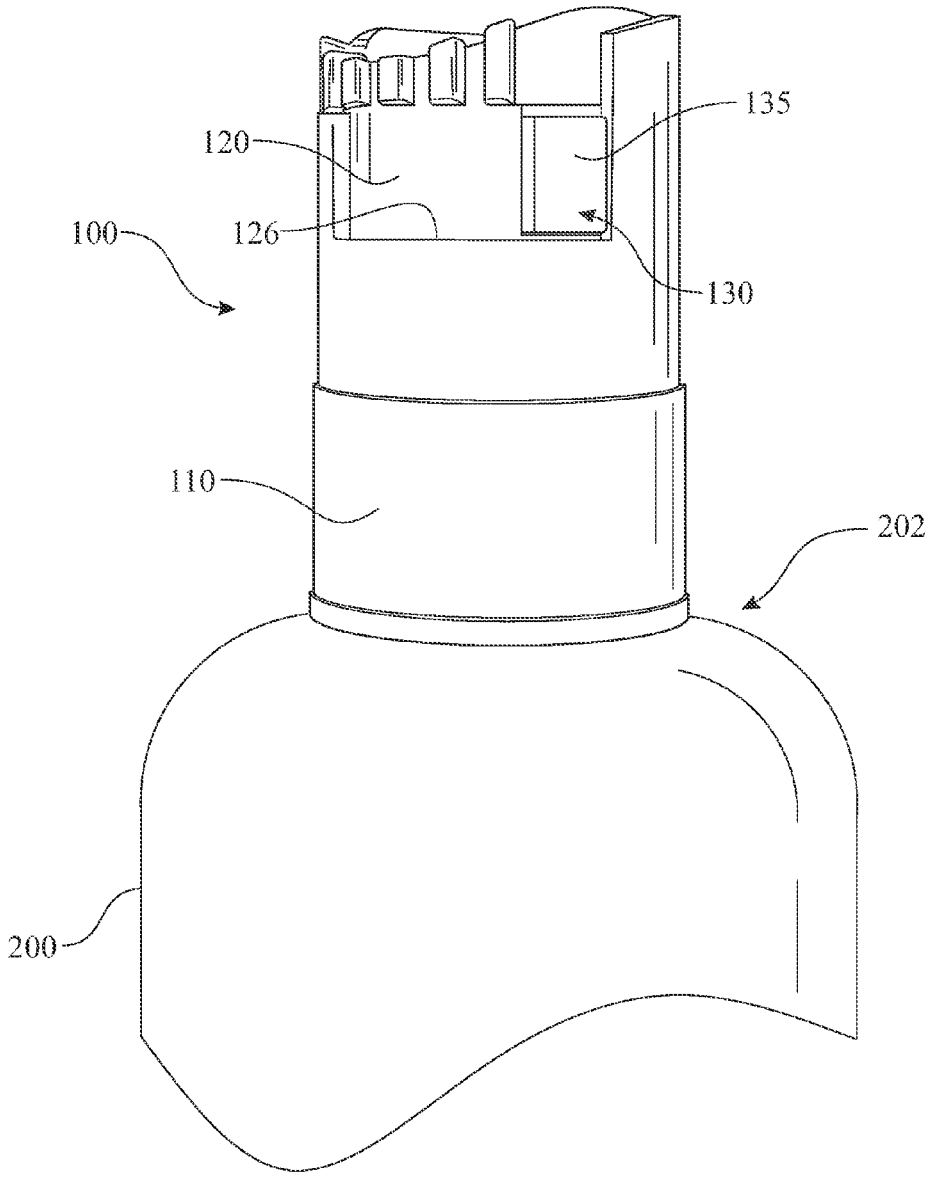
FIG. 1 presents an elevation view of an exemplary embodiment of a child-resistant dispenser or security cap assembled to a container.
Figure 2:
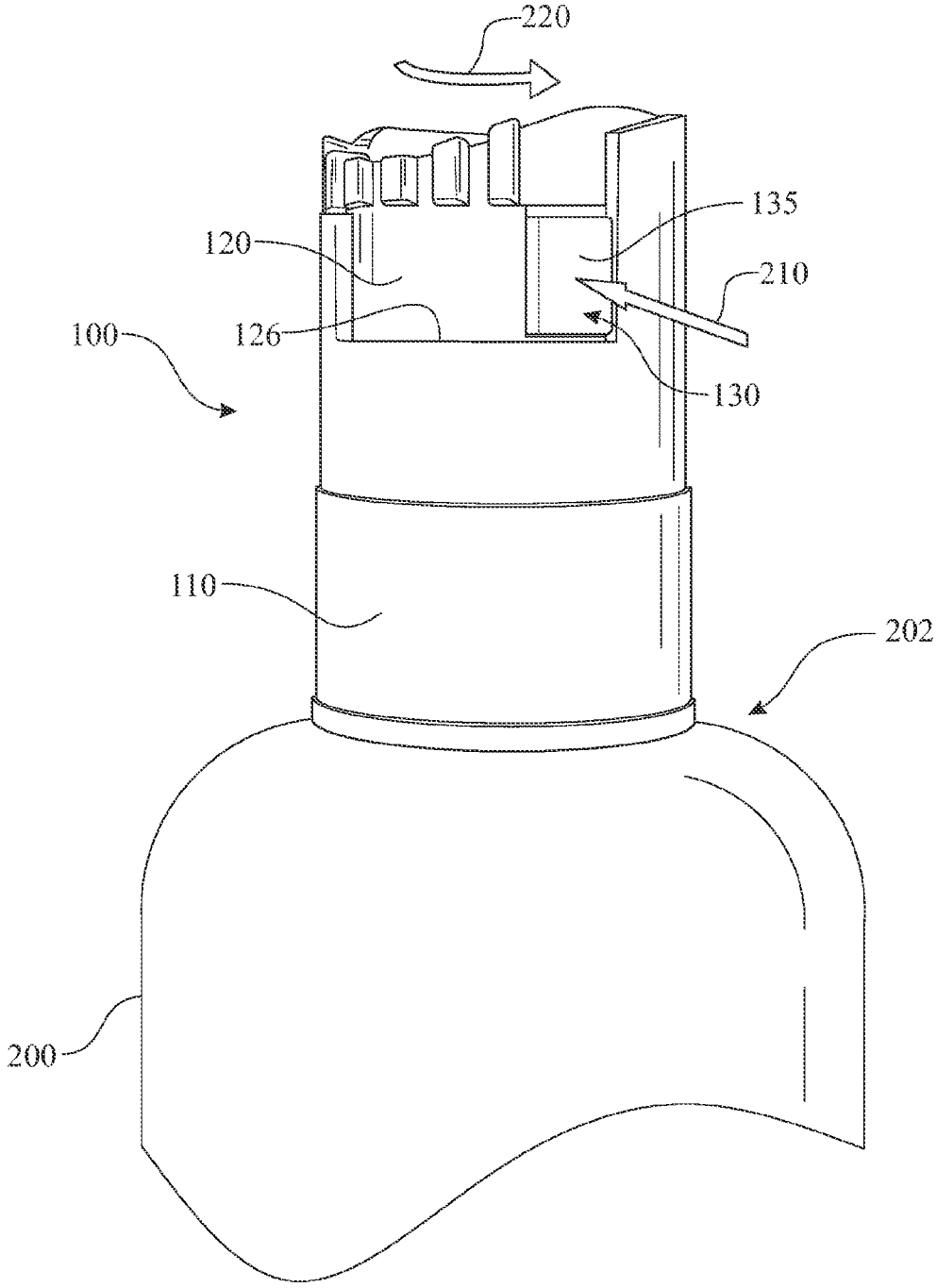
FIG. 2 presents an elevation view of the child-resistant closure introduced in FIG. 1 further including motion indicator arrows representing the motions required to unlock the child-resistant closure.

An exemplary safety closure 100 is illustrated in FIGS. 1 through 10. The access-safety closure 100 can be coupled to or integrated with a container 200 forming a child-resistant package or C-R package as illustrated in FIGS. 1 and 2. The safety closure 100 is used to reduce the risk of children ingesting dangerous items. Child-resistant packaging is required by regulation for prescription drugs, over-thecounter medications, pesticides, and household chemicals. The 100 would be applicable for any pump or aerosol dispensed composition.

The container 200 is configured as a storage vessel defining a volumetric space therein capable of holding a defined volume of a fluid or a defined quantity of dispensable product. The safety closure 100 includes a cylindrical cap body 110, a rotating dispensing actuator 120, and a rotation locking member 130. In combination, to actuate the locking features of the safety closure 100, a user applies an inwardly directed force (as indicated by an arrow representative of an inward motion 210 illustrated in FIG. 2) such that rotation locking member 130 becomes displaced into a central cavity within the rotating dispensing actuator 120, thereby permitting the rotating dispensing actuator 120 to rotate (as indicated by an arrow representative of a rotational motion 220 illustrated in FIG. 2) within the cap body 110. The safety closure 100 is preferably coupled to an upper end 202 of the container 200, wherein the safety closure 100 includes a mechanism for dispensing the contents stored within the container 200. The cap body 110 can be integrated into the container 200 or fabricated as a separate assembly and subsequently attached thereto. The coupling between the safety closure 100 and container 200 may be one of several well-known assembly methods such as a screw-top interface, a press-fit interface, a snap-on interface, a welded interface, and the like. One of ordinary skill in the art would readily appreciate any suitable method can be utilized for combining the safety closure 100 and the container 200.

Figure 3:
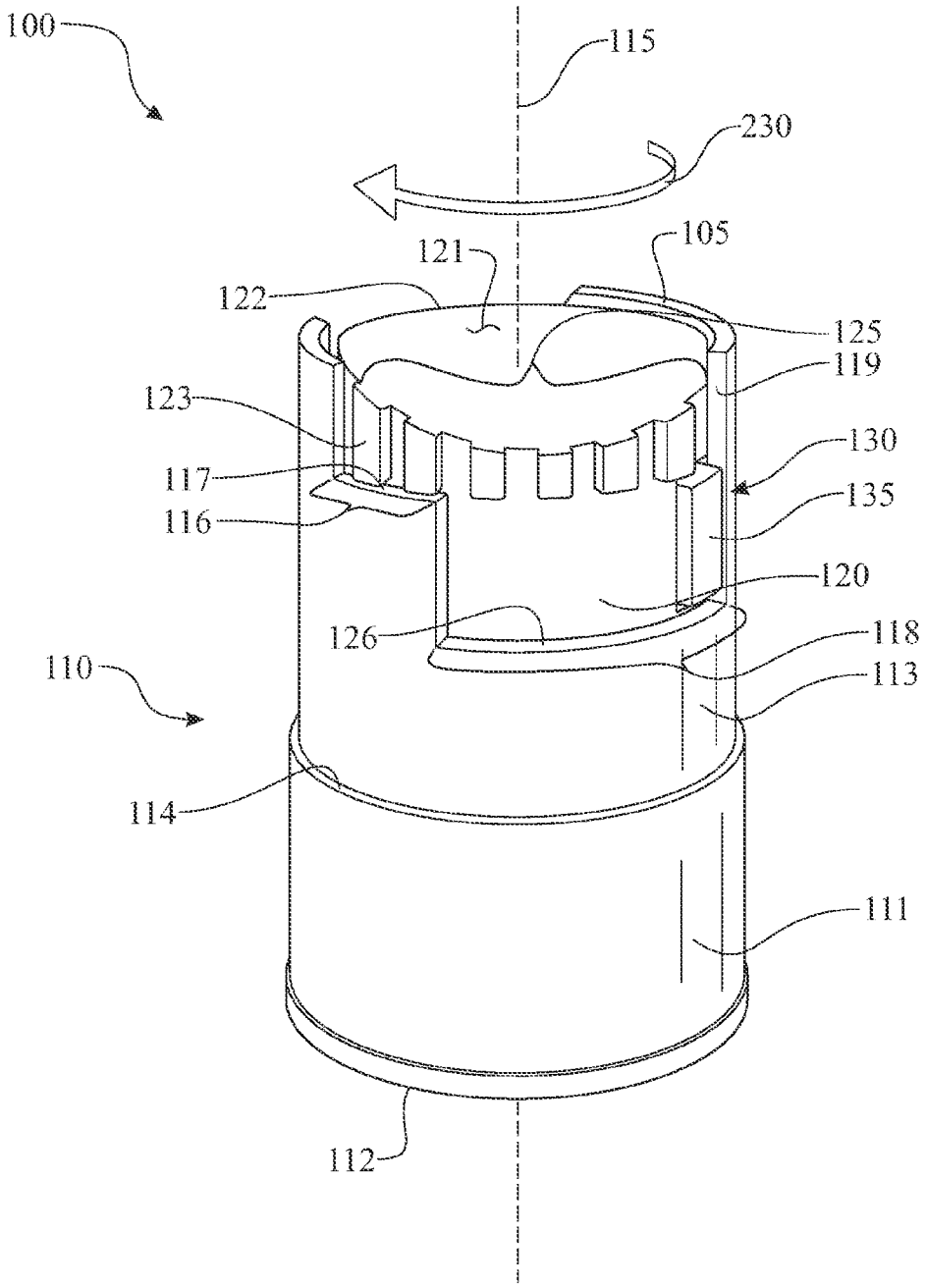
FIG. 3 presents an isometric view of the child-resistant closure introduced in FIG. 1, wherein a projecting locking feature extending radially outward from the outer surface of the actuator and engages with an actuator limit stop placing the child-resistant closure into a locked state as shown.
Figure 4:
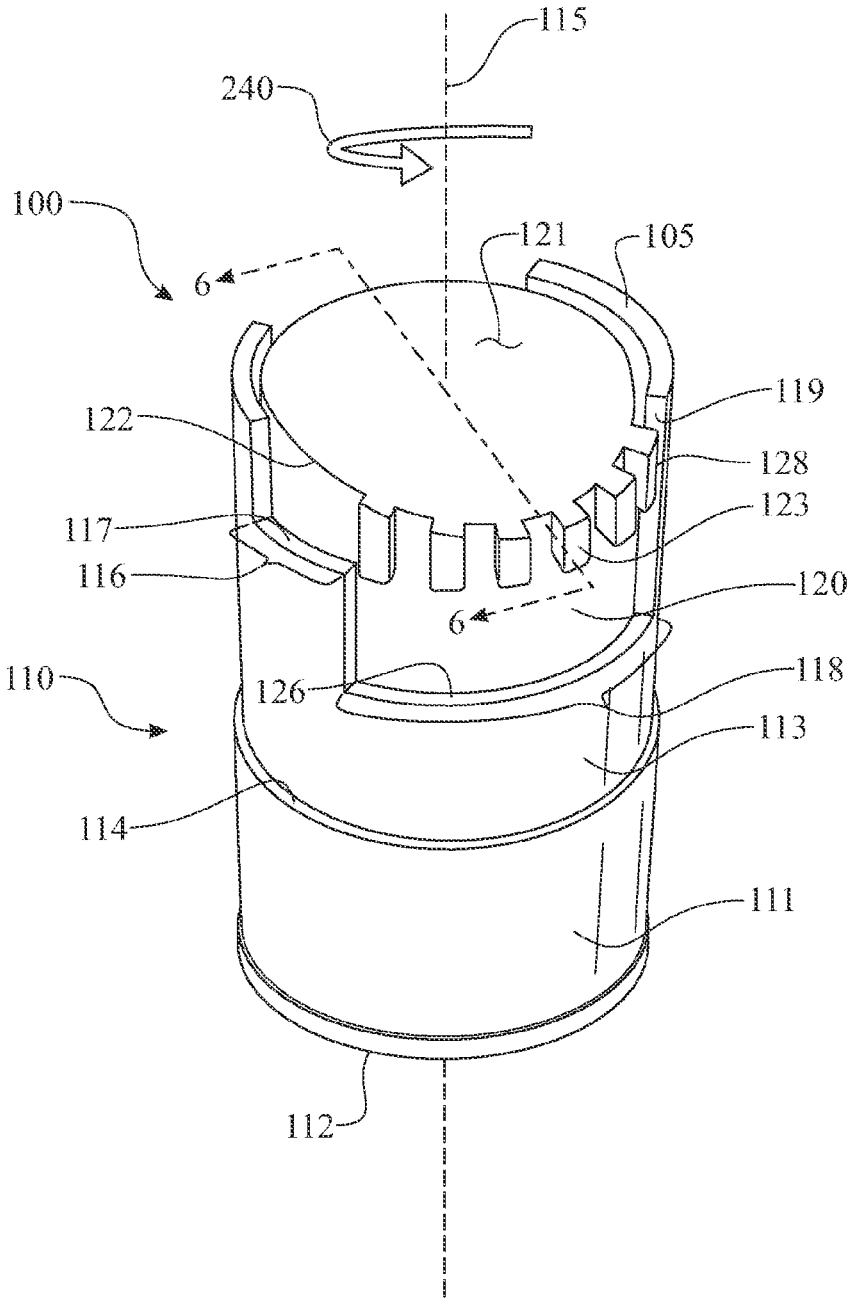
FIG. 4 presents an isometric view of the child-resistant security cap moved from a locked state as illustrated in FIG. 3 to an unlocked state, wherein the projecting locking feature is rotated to align with a vertical actuation enabling clearance formed into a portion of the cap body as shown, enabling vertical motion of the pump actuator.

The cylindrical cap body 110 includes a base portion 111 and an upstanding wall 113. The base portion 111 has a height spanning between a bottom edge 112 and a base portion upper edge 114. The upstanding wall 113 extends upward from the base portion upper edge 114. The upstanding wall 113 is generally cylindrical in shape, having a thin wall and a plurality of relief cuts formed therein. The upstanding wall 113 is bounded between an upstanding wall top edge 105 and the base portion upper edge 114. The upstanding wall 113 includes a first relief cut that extends from the upstanding wall top edge 105 towards the base portion upper edge 114 to thereby form a horizontally arranged actuator limit stop 116. The actuator limit stop 116 prevents downward movement of the rotating dispensing actuator 120 when the rotating dispensing actuator 120 is rotated into a locked configuration as indicated by locking rotational motion 230 shown in FIG. 3. Actuator limit stop 116 provides an actuation governing engagement edge 117 that is configured to engage with a portion of the rotating dispensing actuator 120 when rotated into a locked state. The rotating dispensing actuator 120 includes an upper surface 121. The rotating dispensing actuator 120 additionally includes a projecting locking feature 123 outwardly extending from an upper edge 122 of the rotating dispensing actuator 120. The projecting locking feature 123 is designed to engage with the actuation governing actuation governing engagement edge 117 when rotated into a locked position, and disengage therefrom when rotated into a unlocked, dispensing position. The upstanding wall 113 further includes a second relief cut that extends from the upstanding wall top edge 105 towards the base portion upper edge 114 to thereby form a actuation enabling clearance 118 which provides a recess for a portion of rotating dispensing actuator 120 when rotated into an unlocked position as illustrated in FIG. 4. The user must depress the rotation locking member 130 wherein that rotation locking member 130 becomes displaced behind the upstanding wall 113, enabling the rotation locking member 130 to be rotated past the push-button locking edge 119. This enables the rotating dispensing actuator 120 to be rotated into the unlocked state as indicated by unlocking rotational motion 240 shown in FIG. 4.

In the exemplary embodiment, the first relief cut recess forming the actuator limit stop 116 transcends a longitudinal distance (as aligned with longitudinal axis 115) from the upstanding wall top edge 105 towards the base portion upper edge 114 to a depth point that operatively engages with the projecting locking feature 123. The actuator limit stop 116 is positioned to engage with the projecting locking feature 123 when the rotating dispensing actuator 120 is at an uppermost portion of a dispensing stroke. A second relief cut recess forming actuation enabling clearance 118 can be positioned in arcuate alignment with the first relief cut recess forming actuator limit stop 116 and circumferentially extending from one end of the first relief cut. The second relief cut transcends downward from the upstanding wall top edge 105 a longitudinal distance (as aligned with the longitudinal axis 115) that is substantially equal to a dispensing stroke required to actuate the dispensing mechanism 320 (described in greater detail below with reference to FIG. 6).

The rotating pump actuator 120 is disposed within the cap body 110 and is configured for two (2) directions of motion: (1) a slidable movement parallel to the longitudinal axis 115 and (2) a rotational motion about the longitudinal axis 115. The projecting locking feature 123 is preferably configured as a plurality of rectangular blocks that extend radially outward from rotating dispensing actuator 120. The plurality of rectangular blocks provides a gripping surface for engagement with the user's finger. In an alternate embodiment, projecting locking feature 123 may be configured as a unitary protrusion. The projecting locking feature 123 may include a textured surface to provide an increased frictional interface to aid in the rotational motion.

Figure 5:
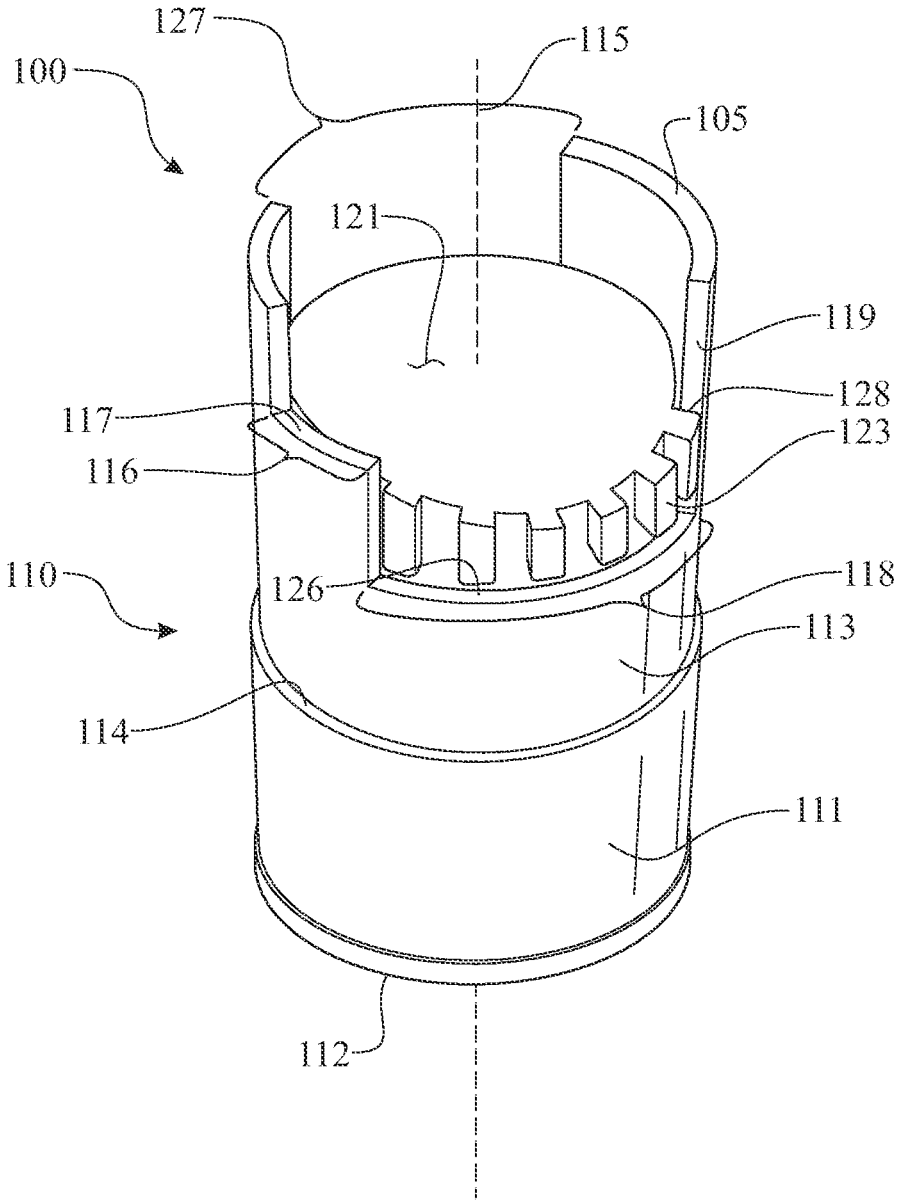
FIG. 5 presents an isometric view of the child-resistant closure after being rotated into an unlocked state, wherein the rotating dispensing actuator enables vertical motion of the pump actuator.

As illustrated in the exemplary embodiment, the projecting locking feature 123 is substantially similar in arc distance to the overall arc distance of actuation enabling clearance 118. Additionally, the arc distance of projecting locking feature 123 combined with the arc distance of the rotation locking member 130 is preferably similar to the combined arc distance 125 of the actuation enabling clearance 118 and the actuator limit stop 116. When the safety closure 100 is placed into an unlocked position as illustrated in FIGS. 4 and 5, the rotating dispensing actuator 120 may be longitudinally depressed such that the projecting locking feature 123 is permitted to travel longitudinally within the actuation enabling clearance 118. At the bottom of the displacement of rotating dispensing actuator 120, the projecting locking feature 123 engages with an actuation stop edge 126 of the actuation enabling clearance 118. As a result of the longitudinal displacement of rotating dispensing actuator 120 within cap body 110, a dispensing mechanism (described below with reference to FIG. 6) may be actuated to dispense a fluid or product stored within container 200.

A nozzle clearance section 127 is formed in a region of the upstanding wall 113 as identified in FIG. 5. The nozzle clearance section 127 is preferably located on the upstanding wall 113 at an area that is opposite from the actuation enabling clearance 118 and extends downward from the upstanding wall top edge 105 towards the base portion upper edge 114. The nozzle clearance section 127 transcends a longitudinal distance that is sufficient to permit discharge from a nozzle/discharge port 300 of the rotating dispensing actuator 120 during the dispensing stroke. The nozzle clearance section 127 is designed to provide a clearance for discharge of a fluid or product from the container 200 through a nozzle or discharge port 300 (FIG. 6) throughout the dispensing stroke of the rotating dispensing actuator 120.

Figure 6:
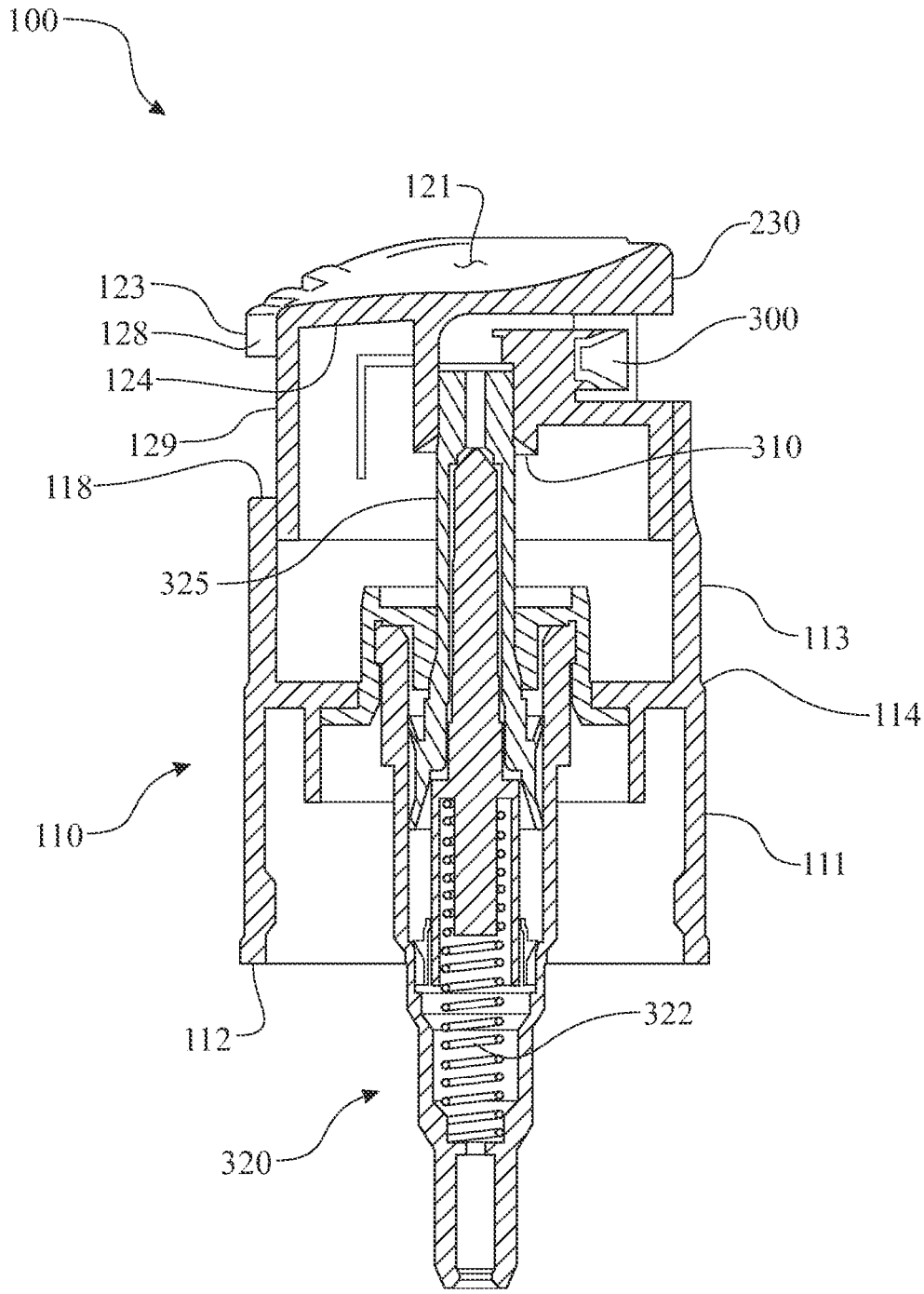
FIG. 6 presents a cross-sectional side view of the child-resistant closure, the section being taken along line 6-6 of FIG. 4.

Details of an exemplary pump are presented in a cross-sectional side view of the safety closure 100 illustrated in FIG. 6. As described in detail above, the cylindrical cap body 110 includes a base portion 111 and an upstanding wall 113. The base portion 111 has a height spanning between a bottom edge 112 and a base portion upper edge 114. The upstanding wall 113 extends upward from the base portion upper edge 114. The rotating dispensing actuator 120 is disposed within a cylindrical cavity formed by the upstanding wall 113. The rotating pump actuator 120 includes a top surface 121, a projecting locking feature 123 and a nozzle or discharge port 300 that is in fluid communication with a central inlet port 310 formed into an inner surface 124 of the rotating dispensing actuator 120. The central inlet port 310 is preferably configured to couple with a discharge end 325 of a dispensing mechanism 320 coupled within the cap body 110. It is contemplated that the dispensing mechanism 320 may be a spring-loaded fluid pump that discharges a predefined amount of fluid for each actuation/dispensing stroke of the dispensing mechanism 320. In an alternate embodiment, the dispensing mechanism 320 may be a finger pump (not shown), a continuous spray aerosol dispensing mechanism (not shown), or a metered spray aerosol dispensing mechanism (not shown), each being configured to dispense a pressurized fluid or product stored within container 200.

Figure 7:
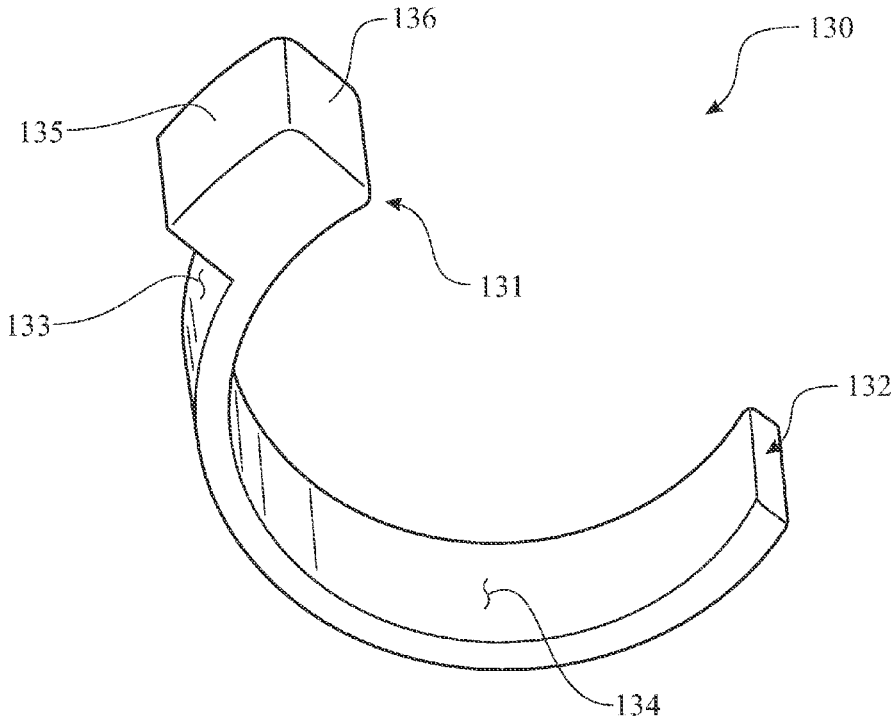
FIG. 7 presents a bottom isometric view of an exemplary rotation locking member.

The exemplary rotation locking member 130 is independently illustrated as an isometric view presented in FIG. 7. The rotation locking member 130 is configured as a semi-circular, ring shaped biasing member that acts as a spring in various operative states of the safety closure 100. The rotation locking member 130 has a locking end 131, an opposite biasing end 132, a convex surface 133 and a concave surface 134. Extending radially outward from the convex surface 133 and adjacent to the locking end 131 is a protruding push button 135. A locking wall engaging surface 136 is defined on the distal end of push button 135 and in one embodiment, is substantially co-planer with the distal end of the locking end 131 of rotation locking member 130. An alternate embodiment includes a rounded transition between the outer surface of the push button 135 and the engaging surface 136 to thereby facilitate sliding motion between the engaging surface 136 and the pushbutton locking edge 119 of the upstanding wall 113. The engaging surface 136 may be slightly angled in an alternate embodiment such that sliding motion between engaging surface 136 and pushbutton locking edge 119 is enhanced. In another embodiment, the push button 135 may be offset from the locking end 131 of the rotation locking member 130 (as illustrated in FIGS. 9 and 10).

The push button 135 can be designed having a height wherein a lower surface thereof rests against the actuation stop edge 126 when placed into the locked configuration. This provides additional restrictions of vertical motion of the rotating dispensing actuator 120. It is noted that the prior art is incapable of achieving this feature, as the design is limited in shape by the hinged interface.

The cap body 110, the rotating dispensing actuator 120 and the rotation locking member 130 may be manufactured using any of the well known manufacturing processes known by those skilled in the art, including injection molding, vacuum forming, machining, and the like. Additionally, it is contemplated that the material selected to fabricate the cap body 110, the rotating dispensing actuator 120 and the rotation locking member 130 may be chosen based upon material properties that provide specific performance of each component for each respective function, such as biasing or spring force characteristics of rotation locking member, rigidity for the cap body 110, and the like. It is also recognized that these components may be fabricated in different colors for any of a multitude of reasons. The cap body 110 and the rotating dispensing actuator 120 are preferably fabricated of the same material, which is preferably injection molded plastic, polypropylene, and the like. The rotation locking member 130 can be fabricated of plastic, silicone, acetyl and the like, preferably fabricated of a material having a geometric memory. Different colors can be used to aid in locating the push button 135. Different colors can be utilized for color-coding features and functionality, and the like.

Figure 8:
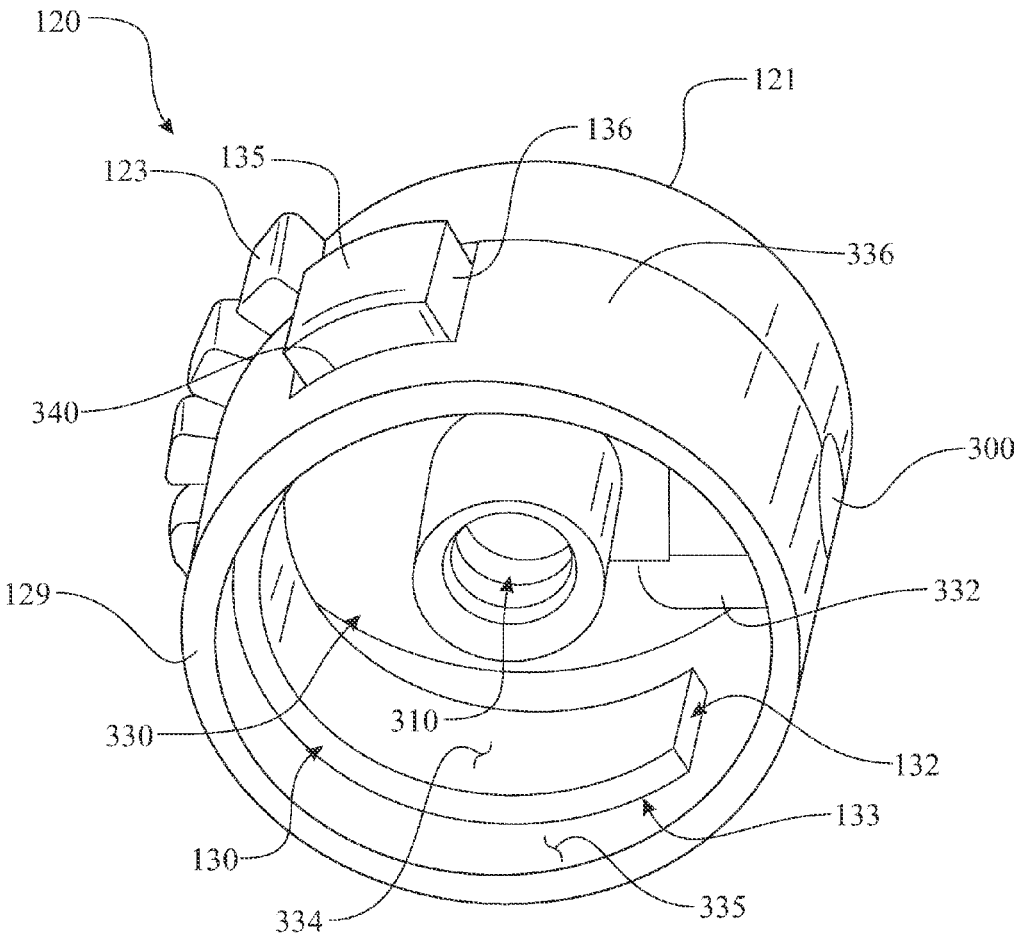
FIG. 8 presents a bottom isometric view of the rotating dispensing actuator having the rotation locking member operatively assembled therein.
Figure 9:
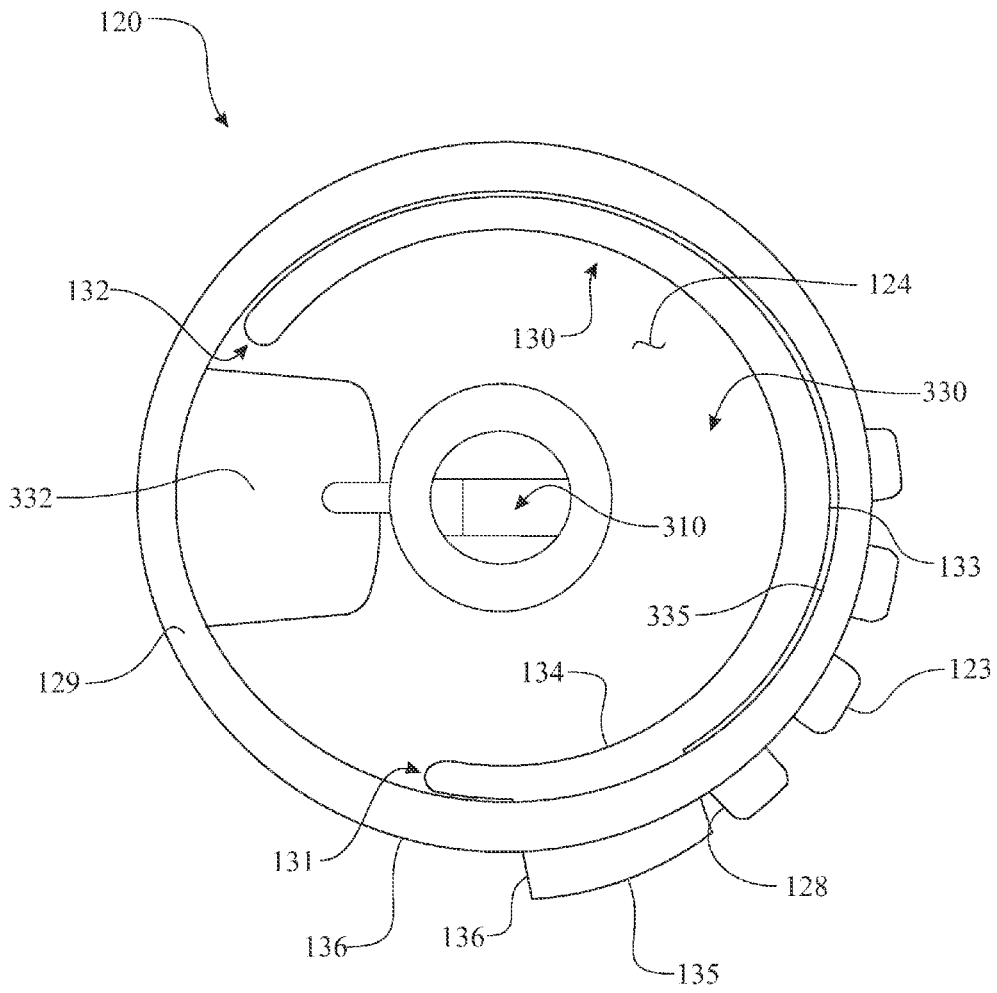
FIG. 9 presents a bottom view of the rotation locking member operatively assembled within the rotating dispensing actuator, wherein the rotation locking member is shown in a locked state.
Figure 10:
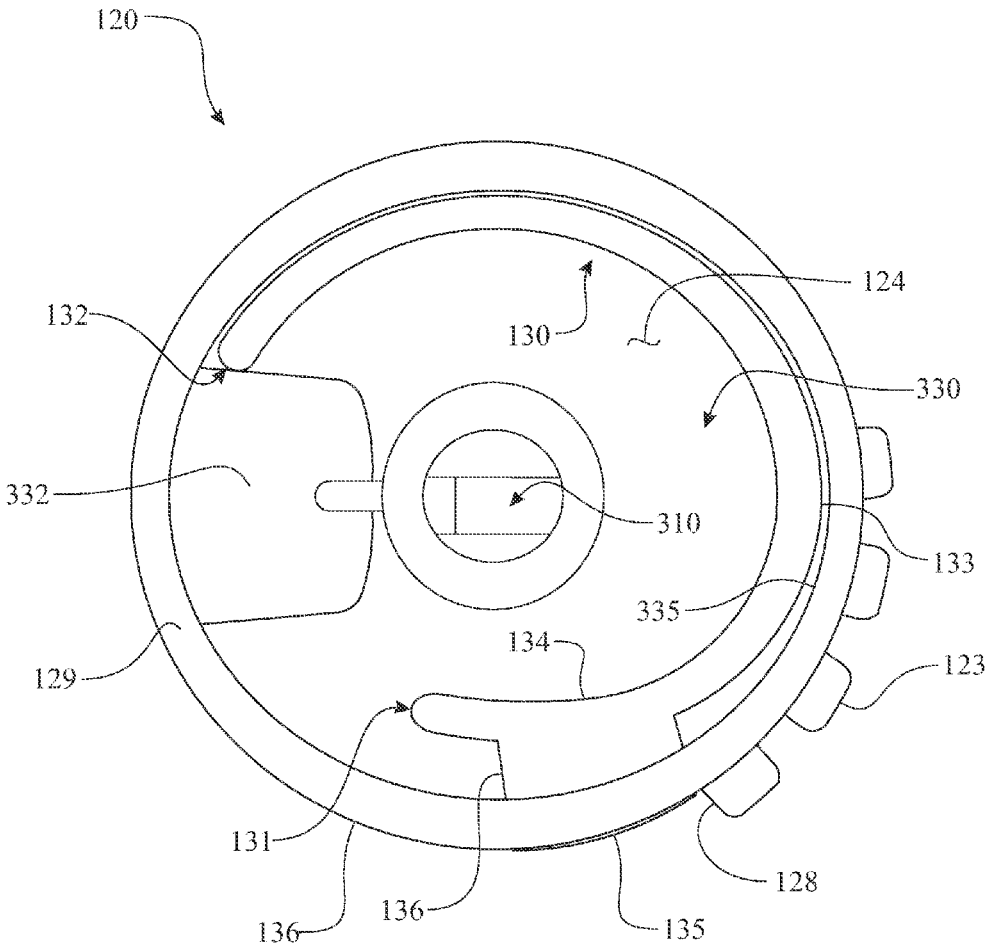
FIG. 10 presents a bottom view of the rotation locking member operatively assembled within the rotating dispensing actuator, wherein the rotation locking member in shown in an unlocked state.

Assembly of the rotation locking member 130 to rotating dispensing actuator 120 and operation thereof is illustrated in FIGS. 8 through 10. The rotating dispensing actuator 120 includes a tubular shaped actuator wall 129 terminating at the upper end wall 121. The upper end wall includes an outer compression receiving surface and an interior surface 124. The inner surface of the tubular shaped actuator wall 129 and the interior surface 124 defines an interior cavity 330 of the rotating dispensing actuator 120. The rotation locking member 130 is positioned within the actuator internal cavity 330 such that the convex surface 133 of rotation locking member 130 is in contact with a concave inner wall 335 of the rotating dispensing actuator 120. A locking button aperture 340 is formed adjacent to one end of projecting locking feature 123. The locking button aperture 340 is sized and configured to accept the push button 135 of the rotation locking member 130 therethrough. The locking button aperture 340 extends circumferentially forward from an unlocking end 128 of the projecting locking feature 123. The push button 135 is sized and shaped to extend radially outward beyond a convex outer wall surface 336 of the rotating dispensing actuator 120 such that the locking wall engage surface 136 operatively engages with the pushbutton locking edge 119 of the upstanding wall 113 (shown in FIGS. 3 through 5). In a relaxed condition, the biasing end 132 of the rotation locking member 130 is positioned having a gap between the biasing end 132 and a biasing member stop feature located within the interior portion of the rotating dispensing actuator 120.

Biased operation of the rotating dispensing actuator 120 within the rotation locking member 130 cycles between a relaxed, locked condition (FIG. 9) and a depressed unlocked condition (FIG. 10). In a relaxed state, the rotation locking member 130 naturally remains in a locked condition, where the push button 135 passes through the locking button aperture 340, extending radially outward beyond the rotating dispensing actuator convex outer surface 336. In the relaxed state, the biasing end 132 of the rotation locking member 130 is spaced apart from an internal fixed bias member limiting feature, wherein the bias member limiting feature can be an internally located discharge conduit 332 of the discharge port 300.

The rotation locking member 130 transitions from a locked condition to an unlocked condition by applying the inward motion 210 to the push button 135 of the rotation locking member 130. The inward motion 210 displaces the push button 135 into the internal cavity 330 of the rotating dispensing actuator 120. The system becomes unlocked when the push button 135 is substantially flush with the concave inner wall 335 of the rotating dispensing actuator 120. When the push button 135 is inwardly displaced, the rotation locking member 130 will shift or rotate such that the biasing end 132 operatively engages with an internal fixed feature 332 such as a portion of discharge port 300. The operative engagement between the biasing end 132 and the internal fixed feature 332 creates a return spring force which is transferred through the rotation locking member 130 to operatively provide a spring force that returns the push button 135 through the locking button aperture 340. It would be appreciated by those skilled in the art that alternative internal fixed features or a specifically provided fixed feature may be employed to provide a structural stop for the biasing end 132 of the rotation locking member when the push button 135 is depressed.

In operation, the safety closure 100 is either integrated with or coupled to the container 200, as illustrated in FIGS. 1 and 2, to control dispensing of fluid or another consumer product that is stored within the volumetric space of container 200. Initially, safety closure 100 is configured in a locked state, as illustrated in FIGS. 1 through 3. When a user decides to access the product within container 200, the user must proceed to unlock the container 200. To begin, the user will apply a force in accordance with an inward motion 210 to depress the push button 135 of the rotation locking member 130 such that the push button 135 no longer engages with the pushbutton locking edge 119 of the upstanding wall 113. While continuing to depress the push button 135, the user simultaneously rotates the rotating dispensing actuator 120 in accordance with the rotational motion 220 of FIG. 2 such that projecting locking feature 123 becomes longitudinally aligned with the actuation enabling clearance 118. During the rotation of the rotating dispensing actuator 120, the push button 135 becomes positioned and retained behind the concave actuator inner wall 335. This configuration of the safety closure 100 enables the user to freely dispense the product from within the container 200. Now the user may longitudinally displace the rotating dispensing actuator 120 in a downward manner, by applying a compressive force to the upper end wall 121. The downward motion of the rotating dispensing actuator 120 actuates the dispensing mechanism 320 to dispense product from within the container 200. An actuator return biasing element 322 returns the rotating dispensing actuator 120 upward to an upright position in preparation for a subsequent dispensing cycle. The dispensing cycle is repeated until the desired volume of product is obtained from the container 200. When the dispensing process is completed, the user rotates the rotating dispensing actuator 120 in accordance with a locking rotational motion 230, returning the projecting locking feature 123 to a locked condition, where the projecting locking feature 123 operatively engages with the actuator limit stop 116 of the upstanding wall 113. Upon positioning the rotating dispensing actuator 120 into the locked position, the push button 135 of the rotation locking member 130 will be biased by the internal spring forces generated by the rotation locking member 130 such that the engaging surface 136 of the push button 135 operatively engages with the pushbutton locking edge 119 of the upstanding wall 113.

As will be now apparent to those skilled in the art, child-resistant safety caps/closures fabricated according to the teachings of the present invention are capable of substantially enhancing the safety and use provided by the dispensing container 200. Since the present invention provides a safety closure 100 that requires two independent motions (the inward motion 210 and the unlocking rotational motion 240) to actuate the dispensing mechanism. In addition, the invention provides a rotation locking member 120 that is configured as a separate component, enabling fabrication of the rotating dispensing actuator 120 and the rotation locking member 130 using different materials. This permits optimal material selection for each component based upon the desired performance characteristics of each component. Importantly, the present invention provides a multi-element safety closure in which each component may be fabricated from materials of different colors to thereby identify and facilitate various functions thereof. Specifically, with the present invention, it is possible to provide a safety closure that permits customization of the spring force of the rotation locking member while simultaneously providing the ability to employ various color-coding schemes between the individual elements. The color differential can aid sight-impaired individuals in locating the push button 135, identifying the projecting locking feature 123, and the like. Finally, the two-piece configuration of the rotating dispensing actuator and rotation locking member enables geometric optimization of these components in addition to permitting tighter tolerances for the locking member.

Although the above provides a full and complete disclosure of the preferred embodiments of the invention, various modifications, combinations, alternate constructions and equivalents will occur to those skilled in the art. For example, although the invention has been described with reference to a semi-circular ring shaped rotation locking member, alternatively the rotation locking member may be configured as sleeve or elongated/wide ring. It is intended that all matters in the foregoing description and shown in the accompanying drawings be interpreted as illustrative and not in a limiting sense. Therefore the above should not be construed as limiting the invention, which is defined by the appended claims and their legal equivalence.

What is claimed is:

1. A safety closure system for a dispensing container, comprising:

a body cap which is one of configured to couple with said dispensing container and integrated into said dispensing container, said body cap comprising an upstanding wall having a recess partially bound by a vertical edge, wherein said vertical edge defines a pushbutton locking edge;

a rotating dispensing actuator comprising an internal cavity, said rotating dispensing actuator rotatably assembled within said body cap to rotatably cycle said rotating dispensing actuator between a locked position to avoid dispensing of material from within said container and an unlocked, dispensing position enabling dispensing of material from within said container; and a rotation locking member comprising an arched segment extending between a locking end and an opposite biasing end, the arched segment defining a convex surface extending between said locking end and said opposite biasing end wherein a contour of said convex surface mimics a contour of said concave inner wall of said rotating dispensing actuator and a push button extending radially outward from said convex surface of said arched segment at a location between said locking end and said opposite biasing end, wherein said rotation locking member is operationally assembled within said actuator internal cavity, said convex surface slideably engages with concave inner wall of the rotating dispensing actuator and said push button engages with said vertical edge to restrict a rotational motion of said rotating dispensing actuator until said push button is subjected to a compression force which positions said push button inward and causes the convex surface to slide along said concave inner wall, clearing said vertical edge, thus enabling rotation of said rotating dispensing actuator.

2. A safety closure system for a dispensing container as recited in claim 1, said rotating dispensing actuator further comprising a projecting locking feature extending radially outward therefrom;

said body cap further comprising an actuator limit stop, wherein said projecting locking feature engages with said actuator limit stop restricting a longitudinal motion of said rotating dispensing actuator until said rotating dispensing actuator is rotated into said unlocked, dispensing position where said projecting locking feature to a position disengaging from said actuator limit stop, thus enabling said longitudinal motion of said rotating dispensing actuator.

3. A safety closure system for a dispensing container as recited in claim 2, wherein when said push button is in an uncompressed state, a locking wall engaging surface of said push button engages with said pushbutton locking edge retaining engagement between said projecting locking feature and said actuator limit stop.

4. A safety closure system for a dispensing container as recited in claim 1, further comprising a fixed feature formed within said internal cavity of said rotating dispensing actuator, wherein said fixed feature operatively engages with a biasing end of said rotation locking member when said push button is depressed placing said rotation locking member into said unlocked, dispensing position.

5. A safety closure system for a dispensing container as recited in claim 1, further comprising a dispensing mechanism coupled to said cap body, wherein said dispensing mechanism is actuated by a longitudinal motion of said rotating dispensing actuator, and said dispensing mechanism dispenses contents stored within said container through a discharge port formed within said rotating dispensing actuator.

6. A safety closure system for a dispensing container as recited in claim 1, wherein said rotation locking member is fabricated having a visually distinguishing feature respective to said rotating dispensing actuator.

7. A safety closure system for a dispensing container as recited in claim 1, wherein said rotating dispensing actuator is fabricated of a material having a first color and said rotation locking member is fabricated of a material having a second color, wherein said first color and said second color are different.

8. A security cap, comprising:

a body cap which is one of configured to couple with said dispensing container and integrated into said dispensing container, said body cap comprising an upstanding wall extending generally longitudinally from said top edge of said body cap, said upstanding wall having a recess extending longitudinally from a top edge of said upstanding wall and partially bound by a vertical edge, wherein said vertical edge defines a pushbutton locking edge;

an upstanding wall extending from said top edge of said body cap, said upstanding wall having a recess extending from a top edge of said upstanding wall and extending towards said top edge of said base portion;

a rotating dispensing actuator comprising an upper end wall defined by an upper peripheral edge and a tubular shaped actuator wall extending downward from said upper peripheral edge, said upper end wall and said tubular shaped actuator wall defining an internal cavity, said rotating dispensing actuator rotatably assembled within said body cap to rotatably cycle said rotating dispensing actuator between a locked position to avoid dispensing of material from within said container and an unlocked, dispensing position enabling dispensing of material from within said container; and a projecting locking feature extending radially outward from an outer surface of said tubular shaped actuator wall;

a locking button aperture formed through said tubular shaped actuator wall; and a rotation locking member comprising an arched segment extending between a locking end and an opposite biasing end, the arched segment defining a convex surface extending between said locking end and said opposite biasing end wherein a contour of said convex surface mimics a contour of said concave inner wall of said rotating dispensing actuator and a push button extending radially outward from said convex surface of said arched segment at a location between said locking end and said opposite biasing end, wherein said rotation locking member is operationally assembled within said actuator internal cavity, said convex surface slideably engages with concave inner wall of the rotating dispensing actuator and said push button engages with said vertical edge to restrict a rotational motion of said rotating dispensing actuator until said push button is subjected to a compression force which positions said push button inward and causes the convex surface to slide along said concave inner wall, clearing said vertical edge, thus enabling rotation of said rotating dispensing actuator.

9. A security cap as recited in claim 8, wherein said at least one recess further defines an actuator limit stop configured for engagement with said projecting locking feature when said actuator is placed in a locked state preventing longitudinal displacement of said rotating dispensing actuator.

10. A security cap as recited in claim 8, wherein when said push button is in an uncompressed state, a locking wall engaging surface of said push button engages with said pushbutton locking edge retaining engagement between said projecting locking feature and said actuator limit stop.

11. A security cap as recited in claim 8, further comprising a fixed feature formed within said internal cavity of said rotating dispensing actuator, wherein said fixed feature operatively engages with said biasing end of said rotation locking member when said rotation locking member is placed in an unlocked state.

12. A security cap as recited in claim 8, further comprising a fixed feature formed within said internal cavity of said rotating dispensing actuator, wherein said fixed feature operatively engages with a biasing end of said rotation locking member when said push button is depressed placing said rotation locking member into said unlocked, dispensing position.

13. A security cap as recited in claim 8, further comprising a dispensing mechanism coupled to said cap body, wherein said dispensing mechanism is actuated by a longitudinal motion of said rotating dispensing actuator, and said dispensing mechanism dispenses contents stored within said container through a discharge port formed within said rotating dispensing actuator.

14. A security cap as recited in claim 8, wherein said rotating dispensing actuator is fabricated of a material having a first color and said rotation locking member is fabricated of a material having a second color, wherein said first color and said second color are different.

15. A security enabled dispensing container, the security enabled dispensing container comprising:

a container body defining an interior volume having a dispensing orifice;

a body cap located in dispensing communication with said dispensing orifice of said dispensing container, said body cap comprising an upstanding wall extending generally longitudinally from said top edge of said body cap, said upstanding wall having a recess extending longitudinally from a top edge of said upstanding wall and partially bound by a vertical edge, wherein said vertical edge defines a pushbutton locking edge;

an upstanding wall extending from said top edge of said body cap, said upstanding wall having a recess extending from a top edge of said upstanding wall and extending towards said top edge of said base portion;

a rotating dispensing actuator comprising an upper end wall defined by an upper peripheral edge and a tubular shaped actuator wall extending downward from said upper peripheral edge, said upper end wall and said tubular shaped actuator wall defining an internal cavity, said rotating dispensing actuator rotatably assembled within said body cap to rotatably cycle said rotating dispensing actuator between a locked position to avoid dispensing of material from within said container and an unlocked, dispensing position enabling dispensing of material from within said container; and a projecting locking feature extending radially outward from an outer surface of said tubular shaped actuator wall;

an actuator limit stop defined by a section of said at least one recess, said actuator limit stop is configured for engagement with said projecting locking feature when said actuator is placed in a locked state preventing longitudinal displacement of said rotating dispensing actuator a locking button aperture formed through said tubular shaped actuator wall; and a rotation locking member comprising an arched segment extending between a locking end and an opposite biasing end, the arched segment defining a convex surface extending between said locking end and said opposite biasing end wherein a contour of said convex surface mimics a contour of said concave inner wall of said rotating dispensing actuator and a push button extending radially outward from said convex surface of said arched segment at a location between said locking end and said opposite biasing end, wherein said rotation locking member is operationally assembled within said actuator internal cavity, said convex surface slideably engages with concave inner wall of the rotating dispensing actuator and said push button engages with said vertical edge to restrict a rotational motion of said rotating dispensing actuator until said push button is subjected to a compression force which positions said push button inward and causes the convex surface to slide along said concave inner wall, clearing said vertical edge, thus enabling rotation of said rotating dispensing actuator.

16. A security enabled dispensing container as recited in claim 15, said recess further comprising an actuator limit stop configured for engagement with said projecting locking feature when said actuator is placed in a locked state preventing longitudinal displacement of said rotating dispensing actuator.

17. A security enabled dispensing container as recited in claim 15, wherein said recess further comprising an actuation enabling clearance configured to permit longitudinal translation of said projecting locking feature within said body cap when said rotating dispensing actuator is placed in an unlocked state, enabling longitudinal displacement of said rotating dispensing actuator.

18. A security enabled dispensing container as recited in claim 15, wherein when said push button is in an uncompressed state, a locking wall engaging surface of said push button engages with said pushbutton locking edge retaining engagement between said projecting locking feature and said actuator limit stop.

19. A security enabled dispensing container as recited in claim 15, further comprising a fixed feature formed within said internal cavity of said rotating dispensing actuator, wherein said fixed feature operatively engages with a biasing end of said rotation locking member when said push button is depressed placing said rotation locking member into said unlocked, dispensing position.

20. A security enabled dispensing container as recited in claim 15, wherein said rotating actuator is fabricated of a material having a first color and said rotation locking member is fabricated of a material having a second color, wherein said first color and said second color are different.

21. A security enabled dispensing container as recited in claim 15, further comprising a dispensing mechanism coupled to said cap body, wherein said dispensing mechanism is actuated by a longitudinal motion of said rotating actuator, and said dispensing mechanism dispenses contents stored within said container through a discharge port formed within said rotating actuator.

22. A security enabled dispensing container as recited in claim 21, wherein said dispensing mechanism is a spring-loaded fluid pump configured to dispense a pre-defined volume of fluid during a dispensing stroke.

23. A security enabled dispensing container as recited in claim 21, wherein said dispensing mechanism is an aerosol metering valve configured to dispense a pressurized fluid stored within said dispensing container.

24. A security enabled dispensing container as recited in claim 15, further comprising a dispensing mechanism in operational communication with said actuator said dispensing mechanism being selected from a dispensing mechanism group consisting of:

a finger pump, a continuous spray aerosol, and a metered spray aerosol.

* * * * *